US011384674B2

(12) United States Patent
Okada et al.

(10) Patent No.: US 11,384,674 B2
(45) Date of Patent: Jul. 12, 2022

(54) REUSE EVALUATION SYSTEM FOR CATALYST

(71) Applicant: TOYOTA JIDOSHA KABUSHIKI KAISHA, Toyota (JP)

(72) Inventors: Tsuyoshi Okada, Nagoya (JP); Masaru Kakinohana, Toyota (JP); Fukutaroh Mori, Anjo (JP); Shogo Shirakawa, Toyota (JP); Yuriko Takahashi, Miyoshi (JP); Masashi Nose, Miyoshi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/206,279

(22) Filed: Mar. 19, 2021

(65) Prior Publication Data

US 2021/0301708 A1 Sep. 30, 2021

(30) Foreign Application Priority Data

Mar. 25, 2020 (JP) ..... JP2020-054266

(51) Int. Cl.
*F01N 11/00* (2006.01)

(52) U.S. Cl.
CPC ..... *F01N 11/002* (2013.01); *F01N 2550/02* (2013.01); *F01N 2900/0422* (2013.01); *F01N 2900/08* (2013.01); *F01N 2900/1602* (2013.01)

(58) Field of Classification Search
CPC ..... F01N 11/002; F01N 2550/02; F01N 2900/1602; F01N 2900/08; F01N 2900/0422
See application file for complete search history.

(56) References Cited

U.S. PATENT DOCUMENTS 5,088,281 A * 2/1992 Izutani ..... F01N 11/007 60/274
2005/0205046 A1* 9/2005 Lewis ..... F02D 13/0257 123/198 F
2006/0230821 A1* 10/2006 Taglialatela-Scafati ..... G01M 15/11 73/114.06
2009/0019833 A1* 1/2009 Yonushonis ..... G01K 1/022 60/277
2010/0115920 A1* 5/2010 Bloms ..... F01N 11/00 60/277
2011/0232269 A1 9/2011 Inoue
(Continued)

FOREIGN PATENT DOCUMENTS

WO 2011/099164 A1 8/2011

*Primary Examiner* — Matthew T Largi
(74) *Attorney, Agent, or Firm* — Oliff PLC

(57) ABSTRACT

A reuse evaluation system is a system that performs an evaluation to reuse a catalyst in a state where the catalyst that purifies an exhaust gas of an engine of a vehicle 1 is mounted on the vehicle. The reuse evaluation system includes a deterioration estimator that estimates a degree of deterioration of the catalyst based on an operating state of the vehicle, a reuse setting unit that sets a range of the degree of deterioration of the catalyst as a reuse range of the catalyst according to a usage of reuse of the catalyst, and a reuse determining unit that determines that the catalyst is reusable in the reuse usages when the degree of deterioration of the catalyst estimated by the deterioration estimator is within the reuse range set by the reuse setting unit.

7 Claims, 7 Drawing Sheets

(56) References Cited

U.S. PATENT DOCUMENTS

| | | | | |
|---|---|---|---|---|
| 2012/0191288 | A1* | 7/2012 | Qi | F01N 3/0814 701/29.1 |
| 2015/0094877 | A1* | 4/2015 | Tahnoose | B60K 35/00 701/1 |
| 2018/0197354 | A1* | 7/2018 | Remboski | G07C 5/008 |
| 2020/0347770 | A1* | 11/2020 | Mendoza-Pinon | F02D 41/1463 |

* cited by examiner

REUSE EVALUATION SYSTEM FOR CATALYST

CROSS REFERENCE TO RELATED APPLICATIONS

The present application claims priority from Japanese patent application JP 2020-054266 filed on Mar. 25, 2020, the entire content of which is hereby incorporated by reference into this application.

BACKGROUND

Technical Field

The present disclosure relates to a reuse evaluation system for a catalyst that performs an evaluation to reuse the catalyst that purifies an exhaust gas of an engine of a vehicle.

Background Art

Conventionally, a vehicle includes an exhaust gas purification device to purify an exhaust gas discharged from an engine of the vehicle. The exhaust gas purification device includes a catalyst that purifies the exhaust gas from the engine. WO2011/099164 discloses to diagnose a deterioration of this catalyst using, for example, a Cmax method. However, when a vehicle was discarded, such a catalyst was discarded together with the vehicle even though the catalyst had a little deterioration.

SUMMARY

While in WO2011/099164, the deterioration of the catalyst is diagnosed from a perspective of a purification performance of the catalyst in the case where the catalyst is mounted on the vehicle, the deterioration of the catalyst is not diagnosed from a perspective of reusing the catalyst. That is, a purification performance requested for the catalyst differs depending on a usage of the catalyst when it is reused.

The present disclosure has been made in view of such a point, and the present disclosure provides a reuse evaluation system that ensures appropriately performing an evaluation of reuse of a catalyst according to a usage of the reuse when the catalyst that purifies an exhaust gas of an engine of a vehicle is reused.

In view of the problem, a reuse evaluation system according to the present disclosure is a system for performing an evaluation to reuse a catalyst in a state where the catalyst that purifies an exhaust gas of an engine of a vehicle is mounted on the vehicle. The system comprises a deterioration estimator, a reuse setting unit, and a reuse determining unit. The deterioration estimator estimates a degree of deterioration of the catalyst based on an operating state of the vehicle. The reuse setting unit sets a range of the degree of deterioration of the catalyst as a reuse range of the catalyst according to a usage of reuse of the catalyst. The reuse determining unit determines that the catalyst is reusable in the reuse usage when the degree of deterioration of the catalyst estimated by the deterioration estimator is within the reuse range set by the reuse setting unit.

According to the present disclosure, first, the deterioration estimator estimates the degree of deterioration of the catalyst based on the operating state of the vehicle. Note that the degree of deterioration of the catalyst is a quantified degree of deterioration of the catalyst, and the higher the degree of deterioration of the catalyst is, the lower the purification efficiency of the exhaust gas by the catalyst becomes. From such a point, the range of the degree of deterioration of the catalyst is set in the reuse setting unit as the reuse range of the catalyst according to the usage of the reuse of the catalyst in the present disclosure. Since the reuse determining unit determines that the catalyst is reusable in the reuse usage when the degree of deterioration of the catalyst estimated by the deterioration estimator is within the reuse range set by the reuse setting unit, the evaluation of the reuse of the catalyst (that is, the catalyst is reusable or not) according to the reuse usage can be appropriately performed when the catalyst is reused.

In some embodiments, the reuse evaluation system further includes a misfire detector that detects a misfire of the engine. When the misfire detector has detected the misfire of the engine, the reuse determining unit determines that the catalyst is unreusable.

Usually, when the misfire of the engine is detected by the misfire detector, an uncombusted gas mixed with a fuel and an intake air passes through the catalyst as the exhaust gas to cause the catalyst to excessively generate heat to often damage the catalyst. Accordingly, since the reuse determining unit can determine such a catalyst is unreusable even though the degree of deterioration of the catalyst is within the reuse range, the evaluation of reuse of the catalyst according to the reuse usage can be appropriately performed when the catalyst is reused.

Here, the degree of deterioration of the catalyst may be estimated from a running distance of the vehicle, an operating period of the engine, and the like. However, in some embodiments, the deterioration estimator estimates the degree of deterioration of the catalyst based on at least one of an output accumulated time, a bed temperature accumulated time, or a combustion accumulated time in a period from the vehicle was manufactured until the degree of deterioration of the catalyst is estimated. The output accumulated time is an accumulated time where the engine is within a predetermined output range. The bed temperature accumulated time is an accumulated time where a bed temperature of the catalyst is within a predetermined range. The combustion accumulated time is an accumulated time where the engine performed lean burn.

Generally, when the output of the engine is within a predetermined range (for example, a range of high output), the exhaust gas discharged from the engine easily deteriorates the catalyst. When the bed temperature of the catalyst is within a predetermined range (for example, a range of higher temperature than a normal temperature) due to purification of the exhaust gas, the catalyst is easily deteriorated. Furthermore, when the engine performs lean burn (when it is driven with an air-fuel mixture thinner than a stoichiometric air-fuel ratio), the bed temperature of the catalyst increases to easily deteriorates the catalyst.

Accordingly, in this aspect, the degree of deterioration of the catalyst is estimated according to at least one value of the output accumulated time, the bed temperature accumulated time, or the combustion accumulated time as the accumulated times of states where the catalyst is easily deteriorated. In view of this, the deterioration estimator can further accurately estimate the degree of deterioration of the catalyst according to the operating state of the vehicle.

Here, the deterioration estimator may estimate the degree of deterioration of the catalyst from, for example, a formula, a graph, or a table, such that, for example, the degree of deterioration of the catalyst increases as at least one value of the output accumulated time, the bed temperature accumulated time, or the combustion accumulated time increases.

However, as described above, while the output accumulated time, the bed temperature accumulated time, and the combustion accumulated time are parameters pertaining to the deterioration of the catalyst, unambiguously estimating the degree of deterioration of the catalyst by one parameter may fail to accurately estimate the degree of deterioration of the catalyst. Accordingly, the degree of deterioration of the catalyst is estimated by comprehensively taking these parameters into account in some embodiments.

As such an aspect, the deterioration estimator further includes a deterioration learning unit that has machine-learned a calculation of the degree of deterioration of the catalyst using the output accumulated time, the bed temperature accumulated time, the combustion accumulated time, and a degree of deterioration of a catalyst as teacher data for each catalyst of a plurality of the catalysts for learning. The deterioration learning unit receives the output accumulated time, the bed temperature accumulated time, and the combustion accumulated time of a catalyst as a target for which degree of deterioration is to be estimated and calculates the degree of deterioration of the catalyst as the target for which degree of deterioration is to be estimated.

This aspect includes the learning unit that has machine-learned the calculation of the degree of deterioration of the catalyst using values of the output accumulated time, the bed temperature accumulated time, and the combustion accumulated time, which have large influences on the degree of deterioration of the catalyst, and the degree of deterioration of the catalyst calculated with these values as the teacher data. The calculation of the degree of deterioration of the catalyst learned by such a learning unit ensures further accurately estimating the degree of deterioration of the catalyst. Note that an actually measured degree of deterioration of the catalyst may be used as the degree of deterioration of the catalyst that serves as the teacher data, and a degree of deterioration of the catalyst estimated for a catalyst that could obtain an effective purification efficiency at the time of reuse among the already estimated degrees of deterioration of the catalysts may be used.

In some embodiments, the reuse evaluation system further includes a deterioration predictor that predicts a progress of the degree of deterioration of the catalyst corresponding to the accumulated time from any one of the accumulated times of the output accumulated time, the bed temperature accumulated time, or the combustion accumulated time, and the degree of deterioration of the catalyst estimated by the deterioration estimator.

According to this aspect, the deterioration estimator can estimate the degree of deterioration of the catalyst with high accuracy, and therefore, the degree of deterioration of the catalyst can be accurately estimated with any one of the accumulated times of the output accumulated time, the bed temperature accumulated time, or the combustion accumulated time as a time axis.

Here, the reuse usage is one and a range of the degree of deterioration of the catalyst may be set for the one reuse usage. However, in some embodiments, the reuse setting unit sets a range of the degree of deterioration of the catalyst for each of a plurality of reuse usages, and the reuse determining unit determines whether the catalyst is reusable based on the range of the degree of deterioration of the catalyst set for each of the plurality of reuse usages. According to this aspect, since the range of the degree of deterioration of the catalyst is set for each of the plurality of reuse usages, the catalyst can be reused in a further wide range of the degree of deterioration of the catalyst.

In some embodiments, the reuse evaluation system for the catalyst may be mounted on each vehicle, but, for example, it may be mounted on a server or the like installed outside the vehicle. For this case, in some embodiments, the deterioration estimator estimates the degree of deterioration of the catalyst of each of the vehicles with respect to the catalysts of a plurality of the vehicles, and the reuse evaluation system further includes a vehicle number specifying unit that identifies a vehicle including a catalyst determined to be reusable among the plurality of vehicles and a number of the vehicle.

According to this aspect, since the vehicle including the catalyst reusable for the usage and the number of the vehicle are identified with respect to the plurality of vehicles, the number of the catalyst that can be supplied as the reusable catalyst can be controlled. This facilitates securing it before the vehicle is discarded.

The present disclosure ensures appropriately performing an evaluation of reuse of a catalyst according to a usage of the reuse when the catalyst that purifies an exhaust gas of an engine of a vehicle is reused.

DETAILED DESCRIPTION

1. Catalyst to be Evaluated for Reuse and Vehicle Including the Same

Figure 1:
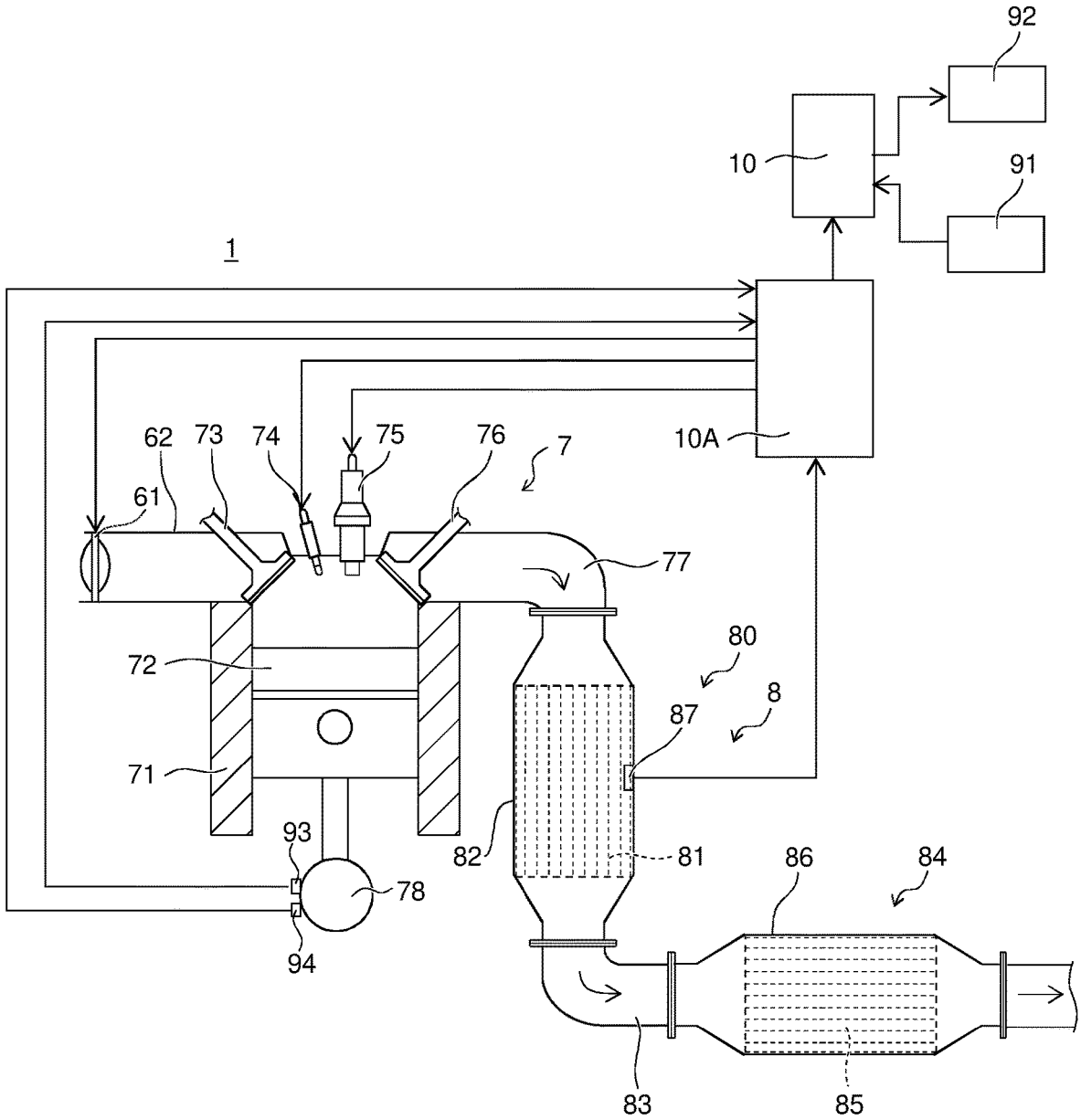
FIG. 1 is a cross-sectional view of a main part of a vehicle including a catalyst evaluated with a reuse evaluation system according to an embodiment of the disclosure.
Figure 2:
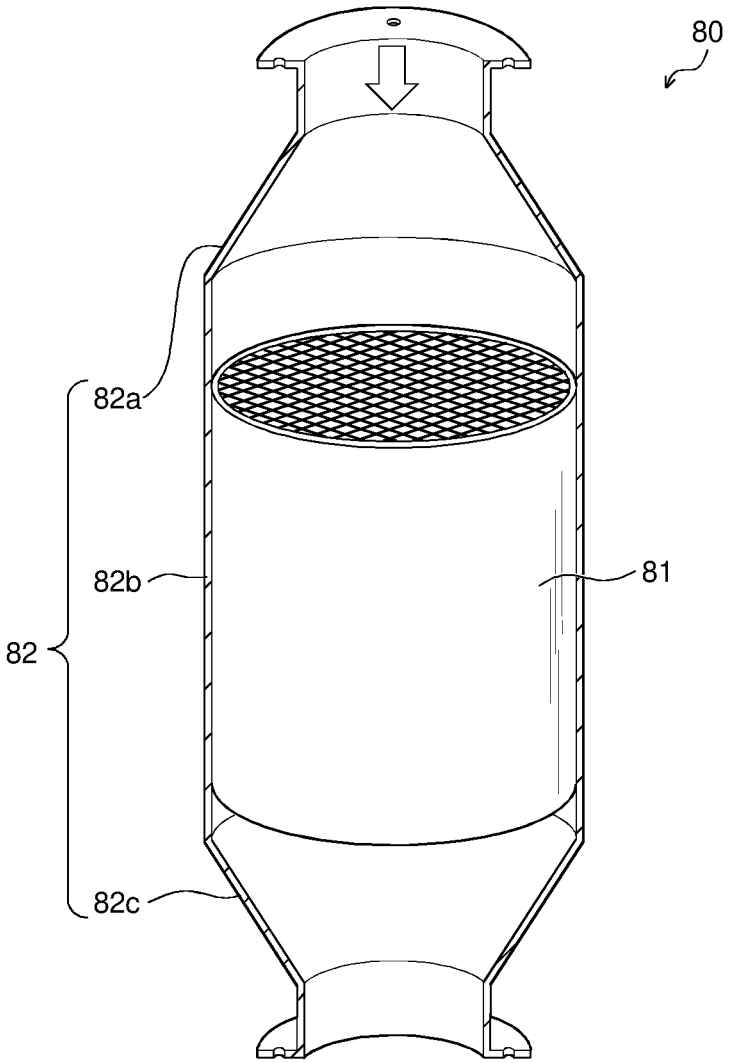
FIG. 2 is a schematic diagram of a catalytic converter including a vehicular catalyst illustrated in FIG. 1.

The following describes a catalyst to be evaluated for reuse and a vehicle including the catalyst with reference to FIG. 1 and FIG. 2.

As illustrated in FIG. 1, an engine 7 mounted on a vehicle is coupled to an intake air pipe 62, and an amount of intake air that passes through the intake air pipe 62 is adjusted by controlling a degree of opening of a throttle valve 61.

The adjusted intake air flows into a combustion chamber 79, formed of a cylinder block 71 and a piston 72, via an intake air valve 73, and is mixed with a fuel (gasoline) injected by a fuel injection valve 74. The mixed air-fuel mixture is ignited by a spark plug 75 and combusted in the combustion chamber 79, an exhaust gas after the combustion is discharged from an exhaust manifold 77 via an exhaust valve 76.

The exhaust gas exhausted from the exhaust manifold 77 is purified in an exhaust gas purification device 8. Specifically, the exhaust gas purification device 8 includes a catalytic converter 80 coupled to the exhaust manifold 77 and a catalytic converter 84 coupled to the catalytic converter 80 in the downstream side of the catalytic converter 80.

The catalytic converter 80 includes a catalyst 81 that purifies the exhaust gas from the exhaust manifold 77 and a housing 82 that houses the catalyst 81. The catalytic converter 84 also similarly includes a catalyst 85 that further purifies the exhaust gas that is not fully purified by the catalytic converter 80 and a housing 86 that houses the catalyst 85. The housings 82 and 86 are made of a metallic material, such as stainless steel, carbon steel, or aluminum.

In this embodiment, the same configurations are employed for the catalytic converter 80 in the upstream side of the exhaust gas and the catalytic converter 84 in the downstream side of the exhaust gas. The following describes the configuration of the catalytic converter 80 in the upstream side in detail, and the description of the configuration of the catalytic converter 84 in the downstream side is omitted.

As illustrated in FIG. 2, the housing 82 of the catalytic converter 80 has an inlet side cone 82*a*, a trunk portion 82*b*, and an outlet side cone 82*c*. The exhaust gas from the exhaust manifold 77 flows into the inlet side cone 82*a*, and the inlet side cone 82*a* has a cone shape with a flow-channel cross section of the exhaust gas enlarges from the upstream side toward the downstream side of the exhaust gas. The trunk portion 82*b* is formed to continue from the inlet side cone 82*a* in the upstream side of the flowing exhaust gas, and has a tubular shape with a constant flow-channel cross section of the exhaust gas. The outlet side cone 82*c* is formed to continue from the trunk portion 82*b* in the upstream side of the flowing exhaust gas, and has a cone shape with a flow-channel cross section of the exhaust gas decreases from the upstream side toward the downstream side of the exhaust gas. The catalyst 81 is arranged within the trunk portion 82*b*.

In this embodiment, since the engine 7 is a gasoline engine, and the catalyst 81 is a three-way catalyst that converts hydrocarbon (HC), carbon monoxide (CO), and nitride oxide (NOx) in the exhaust gas of the gasoline engine.

The catalyst 81 is made of a carrier (catalyst carrier) supporting a metallic catalyst that purifies an exhaust gas. The carrier may be made of any materials of a ceramic material or a metallic material. Examples of the ceramic material can include a porous ceramic material containing any one of, for example, alumina, zirconia, cordierite, titania, silicon carbide, or silicon nitride as a main component. The metallic material is a material having heat resistance and corrosion resistance in some embodiments, and examples of the metallic material can include, for example, stainless steel and aluminum.

In this embodiment, as one example, the carrier of the catalyst 81 is a carrier in a cylindrical shape, made of a ceramic material, and has a honeycomb structure in which a plurality of cells where the exhaust gas passes are formed.

The metallic catalyst of the catalyst 81 is in a granular shape, and is supported via a ceramic material onto an inner wall surface that forms the cells of the catalyst 81. A noble metal containing at least one of platinum, rhodium, or palladium is selected as a metal for the metallic catalyst. Examples of the ceramic material that causes the carrier to support the catalytic metal can include, for example, a mixed material of zirconia and alumina, ceria and alumina, or ceria-zirconia and alumina. For supporting the metallic catalyst on the carrier, coating the carrier with a slurry including the ceramic material and the metallic catalyst described above and firing this ensure it. The catalyst 81 thus mounted on a vehicle 1 is removed from the vehicle 1 in a form of the catalytic converter 80 when it is reused.

In this embodiment, a control device 10A that controls traveling of the vehicle 1 is disposed. The control device 10A is a device that controls, for example, the engine 7 of the vehicle 1, and includes an arithmetic device, such as a CPU, and a storage device, such as a RAM and ROM, which are not illustrated. The arithmetic device computes, for example, a controlled variable for controlling the engine 7 described later.

The engine 7 includes a torque detection sensor 93 that detects a torque of the engine 7 and a crank angle detection sensor 94 that detects an engine speed by detecting a rotation angle of a crankshaft 78. The torque of the engine 7 and the engine speed of the engine 7 detected by these sensors 93 and 94 are input to the control device 10A. Furthermore, the catalytic converter 80 includes a temperature sensor 87 that detects a bed temperature of the catalyst 81, and the detected bed temperature is input to the control device 10A.

The control device 10A outputs, for example, a control signal of a degree of opening of the throttle valve 61, a control signal for controlling an injection timing and an injection amount of the fuel injection valve 74, and a control signal for controlling an ignition timing by the spark plug 75, in order to drive the engine 7 with a predetermined output, corresponding to a request from a driver. This ensures controlling the engine 7 of the vehicle 1.

2. Reuse Evaluation System 10

In this embodiment, the vehicle 1 further includes a reuse evaluation system 10 described above. The reuse evaluation system 10 is a system to perform an evaluation for reusing the catalyst 81 in a state where the catalyst 81 is mounted on the vehicle 1. The reuse evaluation system 10 includes an arithmetic device, such as a CPU, and a storage device, such as a RAM and ROM, which are not illustrated, similarly to the control device 10A, and the reuse evaluation system 10 is coupled to an input device 91 and a display unit 92. A reuse range of the catalyst, which will be described later, is input to the input device 91, and a determination result of the reuse of the catalyst is output to the display unit 92.

Figure 3:
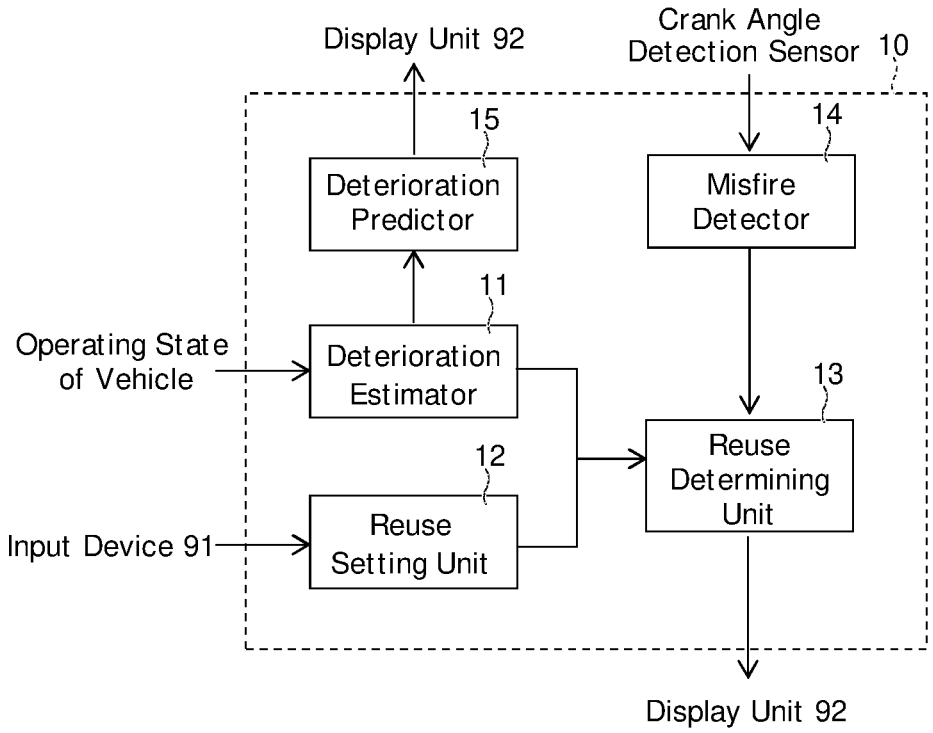
FIG. 3 is a block diagram of the reuse evaluation system illustrated in FIG. 1.

Note that, while in this embodiment, as illustrated in FIG. 1, the control device 10A of the vehicle 1 and the reuse evaluation system 10 are individually disposed, they may be configured in one arithmetic device and storage device. The reuse evaluation system 10, as software, includes a deterioration estimator 11, a reuse setting unit 12, a reuse determining unit 13, a misfire detector 14, and a deterioration predictor 15 as illustrated in FIG. 3.

2-1. Deterioration Estimator 11

The deterioration estimator 11 estimates a degree of deterioration of the catalyst 81 based on an operating state of the vehicle 1. The degree of deterioration of the catalyst 81 is a numerical value that indicates a degree of lowered purification efficiency of purifying the exhaust gas by the catalyst 81. Accordingly, the purification efficiency of the exhaust gas is high when the degree of deterioration of the catalyst 81 is low, and therefore, the catalyst 81 is easily reused.

For example, the deterioration estimator 11 may estimate the degree of deterioration of the catalyst 81 according to a running distance of the vehicle 1, and may estimate the degree of deterioration of the catalyst 81 according to an oxygen storage capacity by measuring the oxygen storage capacity (Cmax) of the catalyst 81 by the Cmax method. In this case, a numerical value corresponding to the oxygen storage capacity may be used as a degree of deterioration of the catalyst. Note that, this Cmax method performs an air-fuel ratio control in which an air-fuel ratio is oscillated about a stoichiometry to forcibly change the air-fuel ratio of the exhaust gas flowing into the catalyst 81 between a lean side and a rich side. During this air-fuel ratio control, the oxygen occlusion capacity of the catalyst 81 can be calculated from an output value of an oxygen sensor (not illustrated) disposed in the downstream side of the catalyst 81.

2-1-1. Estimation of Degree of Deterioration of Catalyst Using Accumulated Time

Figure 4:
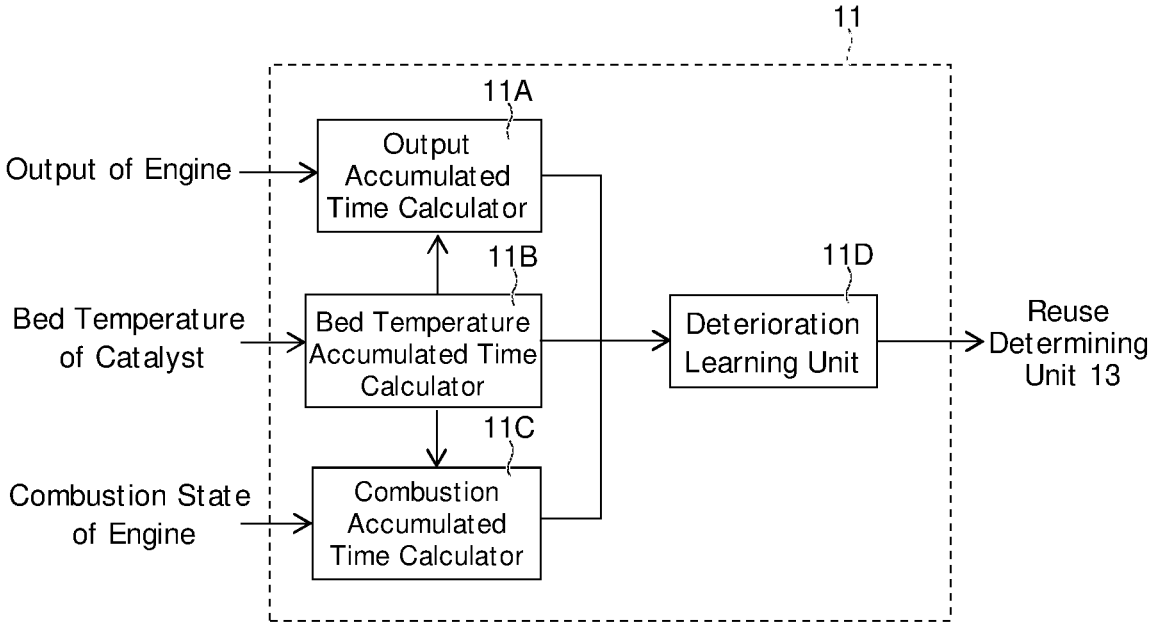
FIG. 4 is a block diagram of a deterioration estimator illustrated in FIG. 1.
Figure 5:
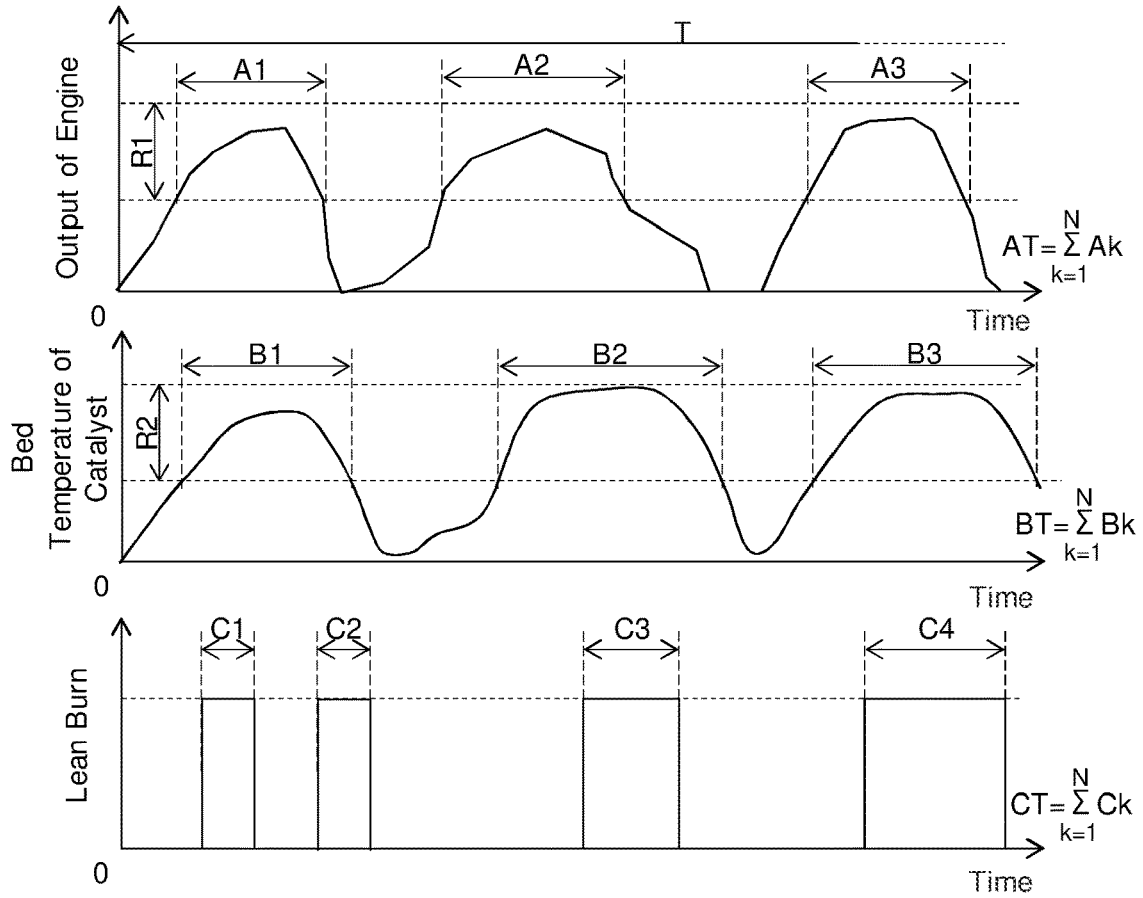
FIG. 5 is a graph for describing a calculation method by an output accumulated time calculator, a bed temperature accumulated time calculator, and a combustion accumulated time calculator illustrated in FIG. 4.

Unlike the above-described estimation of the degree of deterioration of the catalyst, the degree of deterioration of the catalyst 81 is estimated as illustrated in FIG. 4 and FIG. 5 in this embodiment. As illustrated in FIG. 4, the deterioration estimator 11 includes an output accumulated time calculator 11A, a bed temperature accumulated time calculator 11B, a combustion accumulated time calculator 11C, and a deterioration learning unit 11D.

The output accumulated time calculator 11A accumulates a time during which the engine 7 is within a predetermined output range R1 in a period from the vehicle 1 was manufactured until the degree of deterioration of the catalyst 81 is estimated. Specifically, as illustrated in FIG. 5, an output range (a range where an output of the engine 7 is high) R1 of the engine 7 where the deterioration of the catalyst 81 progresses is set with respect to the output of the engine 7 detected by the torque detection sensor 93. The output accumulated time calculator 11A accumulates times A1, A2, A3 . . . in this range R1. This causes the output accumulated time calculator 11A to calculate an output accumulated time AT.

The bed temperature accumulated time calculator 11B accumulates a time during which the bed temperature of the catalyst 81 is within a predetermined temperature range R2 in the period from the vehicle 1 was manufactured until the degree of deterioration of the catalyst 81 is estimated. Specifically, as illustrated in FIG. 5, a temperature range (a high temperature range in activation of the catalyst 81) R2 of the catalyst 81 where the deterioration of the catalyst 81 progresses is set with respect to the bed temperature of the catalyst 81 detected by the temperature sensor 87. The bed temperature accumulated time calculator 11B accumulates times B1, B2, B3 . . . in this range R2. This causes the bed temperature accumulated time calculator 11B to calculate the bed temperature accumulated time BT.

The combustion accumulated time calculator 11C accumulates a time during which the engine 7 performs lean burn in the period from the vehicle 1 was manufactured until the degree of deterioration of the catalyst 81 is estimated. Specifically, as illustrated in FIG. 5, the combustion accumulated time calculator 11C accumulates time C1, C2, C3 . . . during which the engine 7 performed lean burn from a target air-fuel ratio for controlling or the air-fuel ratio of the engine 7 detected by an air-fuel ratio sensor (not illustrated). The combustion accumulated time calculator 11C calculates a combustion accumulated time CT.

The longer the output accumulated time AT, the bed temperature accumulated time BT, and the combustion accumulated time CT get, the larger the degree of deterioration of the catalyst 81 becomes. Accordingly, the deterioration estimator 11 may estimate the degree of deterioration of the catalyst 81 according to any one of the calculated output accumulated time AT, bed temperature accumulated time BT, or combustion accumulated time CT.

However, while the output accumulated time AT, the bed temperature accumulated time BT, or the combustion accumulated time CT are parameters pertaining to the deterioration of the catalyst 81, estimating the degree of deterioration of the catalyst 81 by one parameter may fail to accurately estimate the degree of deterioration of the catalyst 81. Accordingly, the degree of deterioration of the catalyst 81 is estimated by comprehensively taking these parameters into account in some embodiments.

2-1-2. Calculation of Degree of Deterioration of Catalyst by Machine Learning (Artificial Intelligence)

Therefore, in this embodiment, the deterioration learning unit 11D that calculates the degree of deterioration of the catalyst 81 from these accumulated times AT, BT, and CT is disposed. Specifically, the deterioration learning unit 11D has machine-learned a calculation of the degree of deterioration of the catalyst with the output accumulated time, the bed temperature accumulated time, the combustion accumulated time, and the degree of deterioration of the catalyst 81 as teacher data for each catalyst of a plurality of catalysts.

Figure 6:
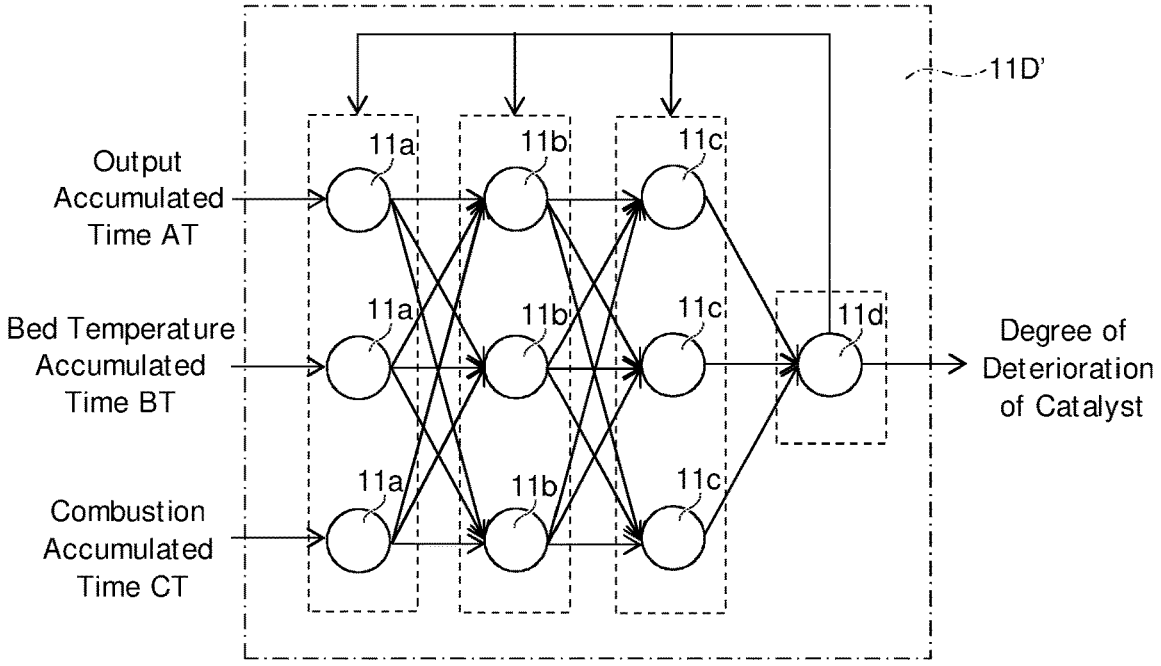
FIG. 6 is a schematic diagram illustrating an exemplary deterioration learning unit illustrated in FIG. 4.

In this embodiment, the deterioration learning unit 11D is configured of a deep neural network 11D' ((DNN): hereinafter referred to as a "neural network") illustrated in FIG. 6 as one example. The output accumulated time A1, the bed temperature accumulated time B1, and the combustion accumulated time C1 of the catalyst 81 as a target for which degree of deterioration is to be estimated is input to the neural network 11D' of the deterioration learning unit 11D, and the degree of deterioration of the catalyst 81 as the target for which degree of deterioration is to be estimated is calculated.

The neural network 11D' includes an input neuron element 11*a* to which the output accumulated time A1, the bed temperature accumulated time B1, and the combustion accumulated time C1 are input, an output neuron element 11*d* from which the degree of deterioration of the catalyst 81 is output, and intermediate neuron elements 11*b* and 11*c* that serve as middle layers to couple them. While in this embodiment, the intermediate neuron elements 11*b* and 11*c* are configured of two layers, the number of the layers is not limited to this. As illustrated in FIG. 6, each of the neuron elements 11*a*, 11*b*, 11 *c*, and 11*d* are linked in this order. A neuron parameter computed by this linked neuron element is input to each of the neuron elements, and values obtained by substituting an activation function for this neuron parameter are multiplied by weighting factors to compute a new neuron parameter.

When learning the calculation of the degree of deterioration of the catalyst 81 as an artificial intelligence, the output accumulated time, the bed temperature accumulated time, and the combustion accumulated time calculated for the catalyst for learning are input to the input neuron element 11*a*. Together with this, the degree of deterioration of the catalyst for learning is also input. This causes the output neuron element 11*d* to calculate the degree of deterioration of the catalyst, and the weighting factor of each neuron element is corrected such that this degree of deterioration of the catalyst falls within the predetermined range, and thus, the learning of the calculation of the degree of deterioration of the catalyst is performed. As the teacher data, the output accumulated time, the bed temperature accumulated time, and the combustion accumulated time for an actually used catalyst and the degree of deterioration of the catalyst measured for this catalyst are used. The measured degree of deterioration of the catalyst may be, for example, a value measured by the above-described Cmax method, and the degree of deterioration of the catalyst used as the teacher data is not specifically limited as long as the degree of deterioration of the catalyst can be more accurately measured or calculated.

Thus, the neural network 11D' established by correcting the weighting factor is used in a phase of utilization of an artificial intelligence. In view of this, when the output accumulated time AT, the bed temperature accumulated time BT, and the combustion accumulated time CT of the catalyst 81 as the target for which degree of deterioration is to be evaluated are input to the input neuron element 11*a*, the degree of deterioration of the catalyst 81 is calculated from the output neuron element 11*d*, and the degree of deterioration of the catalyst 81 can be more accurately estimated.

2-2. Reuse Setting Unit 12

Figure 7:
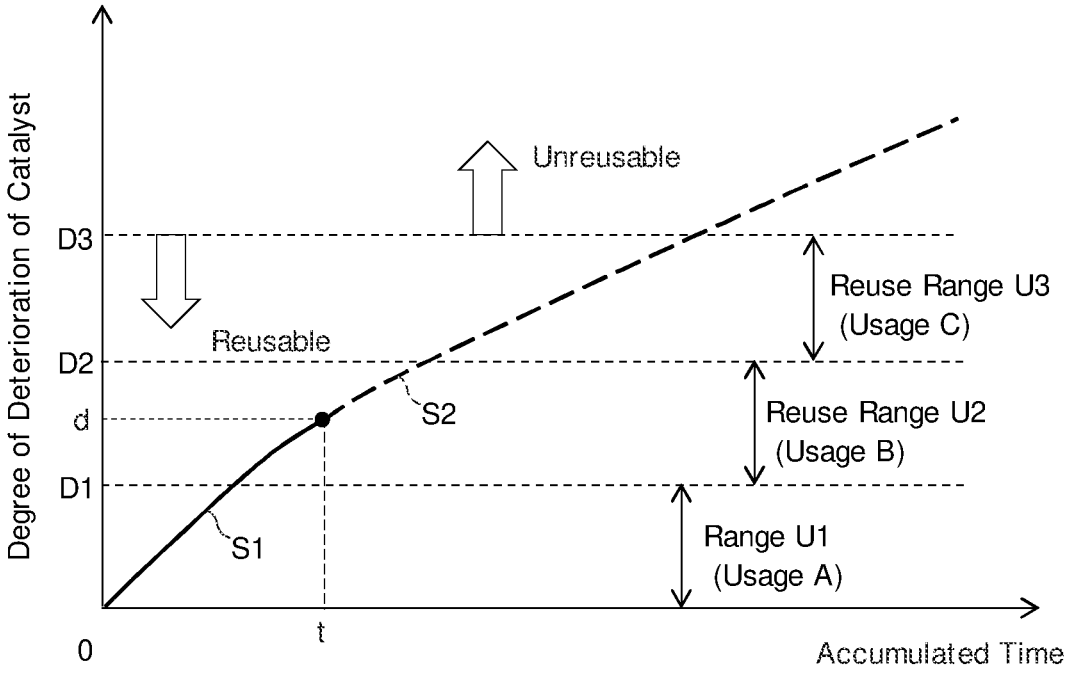
FIG. 7 is a graph for describing a setting for each of a plurality of reuse usages by a deterioration setting unit and a prediction of the deterioration of the catalyst performed by a deterioration predictor illustrated in FIG. 4.

The reuse setting unit 12 sets the range of the degree of deterioration of the catalyst 81 as a reuse range of the catalyst 81 according to a usage of reuse of the catalyst 81. In this embodiment, as illustrated in FIG. 7, the reuse setting unit 12 sets ranges of the degree of deterioration of the catalyst 81 for each of usages A to C of a plurality of reuses. These settings are performed via the input device 91.

The reuse setting unit 12 sets a range where the degree of deterioration of the catalyst 81 is 0 or more and less than D1 as a reuse range U1 in reuse usage A. Similarly, the reuse setting unit 12 sets a range where the degree of deterioration of the catalyst 81 is D1 or more and less than D2 as a reuse range U2 in reuse usage B. Similarly, the reuse setting unit 12 sets a range where the degree of deterioration of the catalyst 81 is D2 or more and less than D3 as a reuse range U3 in reuse usage C.

Note that, in this embodiment, a range where the degree of deterioration of the catalyst 81 is D3 or more is set as a range where the catalyst 81 is unreusable. Note that, while in this embodiment, the three reuse usages A to C are exemplarily illustrated, one reuse usage and a reuse range corresponding to this may be set or a plurality of reuse usages other than three and reuse ranges corresponding to these may be set.

Here, in FIG. 7, the reuse ranges U1 to U3 are sectioned such that the ranges of the degree of deterioration of the catalyst do not overlap corresponding to the reuse usages A to C, but the ranges of the degree of deterioration of the catalyst may overlap for the reuse ranges U1 to U3.

For example, the reuse usage A is use of the catalyst 81 for replacement for another vehicle with a damaged catalyst. The reuse usage B is use of the catalyst to generate hydrogen. Specifically, the catalytic converter 80 including the catalyst 81 is installed on a supply pipe to which a gas containing carbon monoxide (for example, city gas) and water vapor is supplied and a discharge pipe. The carbon monoxide and the water vapor are supplied via the supply pipe, and by their reforming reactions, hydrogen and carbon dioxide are generated. The reuse usage C is use of the catalyst 81 that purifies an exhaust gas discharged from a furnace and the like.

The reuse usages A to C are the examples and the usages are not limited to these. The reuse ranges U1 to U3 of the catalyst corresponding to the reuse usages A to C are determined by a performance required to the catalyst 81.

2-3. Reuse Determining Unit 13

The reuse determining unit 13 determines that the catalyst 81 is reusable in the reuse usage U1 (U2, U3) when the degree of deterioration of the catalyst 81 estimated by the deterioration estimator 11 is within the reuse range U1 (U2, U3) set by the reuse setting unit 12.

In this embodiment, the reuse determining unit 13 determines whether the catalyst 81 is reusable based on the range of the degree of deterioration of the catalyst 81 (that is, the reuse ranges U1, U2, and U3) set for each of the plurality of reuse usages A to C. For example, as illustrated in FIG. 7, when the degree of deterioration of the catalyst 81 is estimated as "d" by the deterioration estimator 11, the degree of deterioration "d" is in the reuse range U2 as the range of D1 or more and less than D2, and therefore, it is determined as the reuse usage B. Note that when the degree of deterioration of the catalyst 81 is D3 or more by the deterioration estimator 11, it is determined that there is no reuse usage (that is, reuse is impossible) of the catalyst 81. Thus, the result determined by the reuse determining unit 13 is output to the display unit 92.

2-4. Misfire Detection of Misfire Detector 14 and Reuse Determination

The misfire detector 14 detects a misfire of the engine 7. The misfire of the engine 7 is determined that a fuel injected in the combustion chamber 79 of the engine 7 is not combusted (the engine 7 misfired) when, for example, the misfire detector 14 calculates an engine speed of the engine 7 from a rotation angle of the crankshaft 78 detected by the crank angle detection sensor 94, and a variation of the engine speed of the engine 7 exceeds a predetermined range.

Here, the reuse determining unit 13 determines that the catalyst 81 is unreusable when the misfire of the engine 7 has been detected by the misfire detector 14. In this case, the reuse determining unit 13 determines that the reuse of the catalyst 81 is impossible even when the degree of deterioration of the catalyst 81 is within the range where the reuse is possible (specifically, the degree of deterioration of the catalyst is less than D3).

Thus, when the misfire of the engine is detected by the misfire detector 14, an uncombusted gas mixed with the fuel and the intake air passes through the catalyst 81 as the exhaust gas to cause the catalyst 81 to excessively generate heat to often damage the catalyst 81. Accordingly, since the reuse determining unit 13 can determine such a catalyst 81 is unreusable even though the degree of deterioration of the catalyst 81 is within the reuse range, the evaluation of reuse of the catalyst 81 according to the reuse usage can be appropriately performed when the catalyst 81 is reused. Thus, the result determined by the reuse determining unit 13 is output to the display unit 92 together with the result of the misfire of the engine 7.

2-5. Deterioration Predictor 15

The deterioration predictor 15 predicts a progress of the degree of deterioration of the catalyst 81 corresponding to the accumulated time from any one of the accumulated times of the output accumulated time, the bed temperature accumulated time, or the combustion accumulated time calculated by the deterioration estimator 11 and the degree of deterioration of the catalyst 81 estimated by the deterioration estimator 11.

Specifically, as illustrated in FIG. 7, for example, using any one of the accumulated times of the output accumulated time, the bed temperature accumulated time, or the combustion accumulated time as a time axis, the degree of deterioration of the catalyst 81 is estimated as the accumulated time increases. As illustrated in FIG. 7, for example, continuously estimating the degree of deterioration of the catalyst 81 by the deterioration estimator 11 ensures obtaining a deterioration curve 51 for a period by an accumulated time t.

Next, a deterioration prediction curve S2 of the degree of deterioration of the catalyst 81 that increases as the accumulated time proceeds is calculated from this deterioration curve 51. For the deterioration prediction curve S2, by setting a standard curve (not illustrated) of the degree of deterioration of the catalyst 81 with respect to the accumulated time using, for example, a function for a catalyst of the same kind as the catalyst 81, the deterioration prediction curve S2 may be calculated from this function. When the deterioration curve 51 is approximately rectilinear, the deterioration prediction curve S2 may be calculated by a least-square method by assuming that this deterioration curve 51 and the deterioration prediction curve S2 are straight. Thus, the deterioration predictor 15 predicts the progress of the degree of deterioration of the catalyst 81 corresponding to the accumulated time, and outputs this prediction result to the display unit 92, for example, in a form of a graph illustrated in FIG. 7, in a form of a table of the accumulated time and the degree of deterioration of the catalyst that increase from now on. Thus, predicting the degree of deterioration of the catalyst 81 ensures predicting reusability of the catalyst 81 in the usage.

3. Reuse Evaluation Method Using Reuse Evaluation System 10

Figure 8:
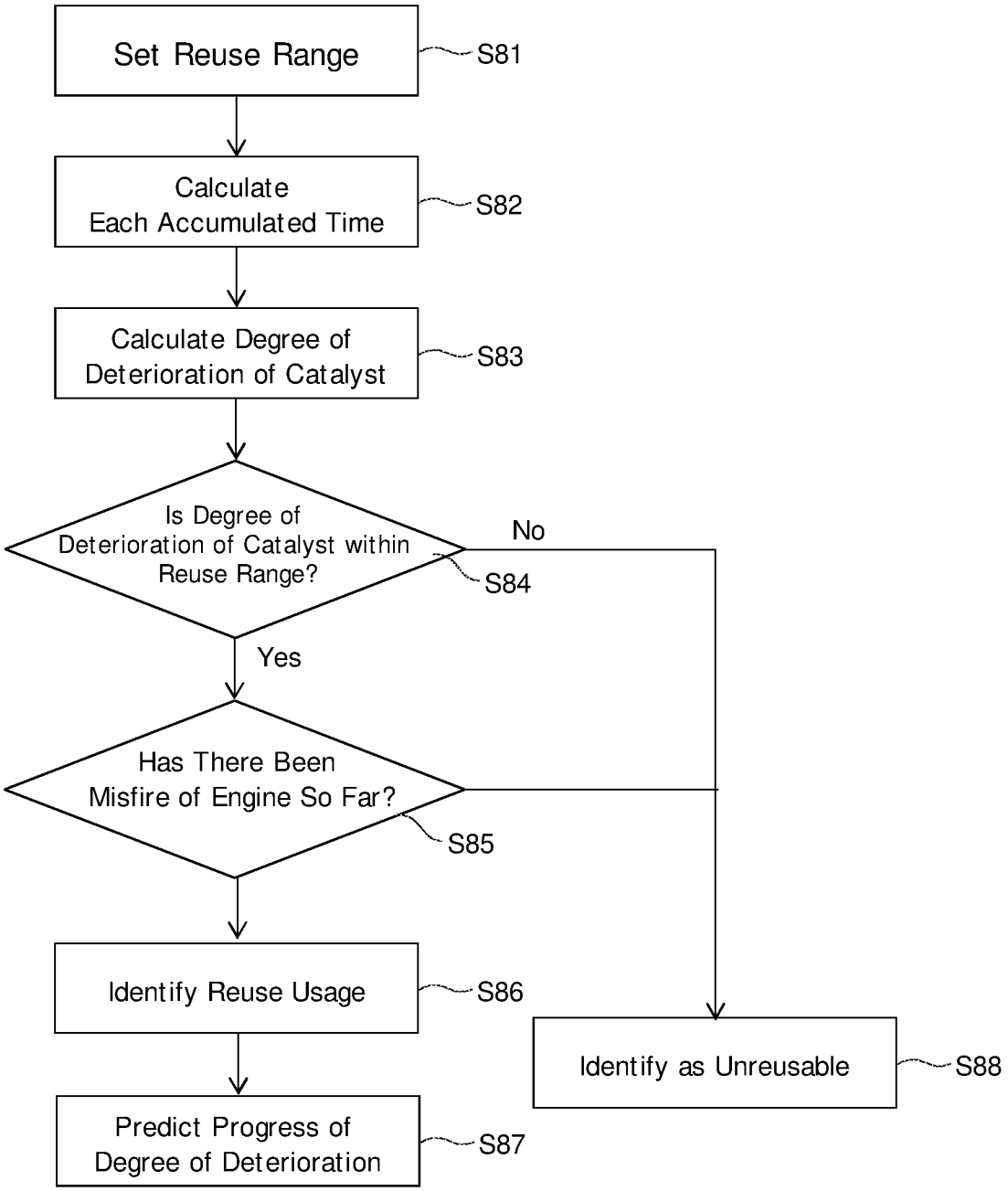
FIG. 8 is a flowchart for describing an evaluation method for reusing the catalyst using the reuse evaluation system for catalyst according to the embodiment.

The following describes a reuse evaluation method with reference to a flowchart illustrated in FIG. 8. First, at Step S81, a reuse range of the catalyst 81 according to a reuse usage of the catalyst 81 is set via the input device 91. This sets the range of the degree of deterioration of the catalyst 81 in the reuse setting unit 12 according to the reuse usage of the catalyst 81.

Next, at Step S82, the output accumulated time calculator 11A, the bed temperature accumulated time calculator 11B, and the combustion accumulated time calculator 11C of the deterioration estimator 11 calculate an output accumulated time AT, a bed temperature accumulated time BT, and a combustion accumulated time CT in a state where the catalyst 81 that purifies an exhaust gas of the engine 7 of the vehicle 1 is mounted on the vehicle 1.

Next, at Step S83, the output accumulated time AT, the bed temperature accumulated time BT, and the combustion accumulated time CT, which are calculated, are input in the deterioration learning unit 11D, and the deterioration learning unit 11D calculates the degree of deterioration of the catalyst 81. Thus, the deterioration estimator 11 can estimate the degree of deterioration of the catalyst 81 in the state of being mounted on the vehicle 1. Note that, in the deterioration learning unit 11D, those (program) learned from the teacher data described above has been generated and saved before Step S81.

Next, at Step S84, the reuse determining unit 13 determines whether the degree of deterioration of the catalyst 81 estimated by the deterioration estimator 11 is within the reuse range set by the reuse setting unit 12. Note that the reuse range referred to here is that the degree of deterioration of the catalyst 81 is within the range of 0 or more and less than D3 illustrated in FIG. 7. Here, when the degree of deterioration of the catalyst 81 is outside the reuse range set by the reuse setting unit 12, that is, when the degree of deterioration of the catalyst 81 is D3 or more, the procedure proceeds to Step S88, and the reuse determining unit 13 determines that the catalyst 81 is not reusable.

At Step S85, when the degree of deterioration of the catalyst 81 is within the reuse range set by the reuse setting unit 12, the procedure proceeds to Step S85, and the misfire detector 14 determines whether a misfire of the engine 7 mounted on the vehicle 1 is detected or not. Here, when the misfire of the engine 7 is detected, the procedure proceeds to Step S88, and the reuse determining unit 13 determines that the catalyst 81 is not reusable.

At Step S86, since the catalyst 81 is reusable from the series of Steps, a reuse usage of the catalyst 81 is identified based on the degree of deterioration of the catalyst 81. For example, in the case illustrated in FIG. 7, the catalyst 81 has the degree of deterioration of the catalyst 81 of "d," and therefore, it is determined to be the reuse usage B.

At Step S87, the deterioration predictor 15 predicts a progress of the deterioration of the catalyst 81, and outputs the result obtained through the series of these Steps to the display unit 92.

Thus, this embodiment ensures appropriately performing an evaluation of reuse of the catalyst 81 according to the reuse usage when the catalyst 81 that purifies an exhaust gas of the engine 7 of the vehicle 1 is reused.

Figure 9:
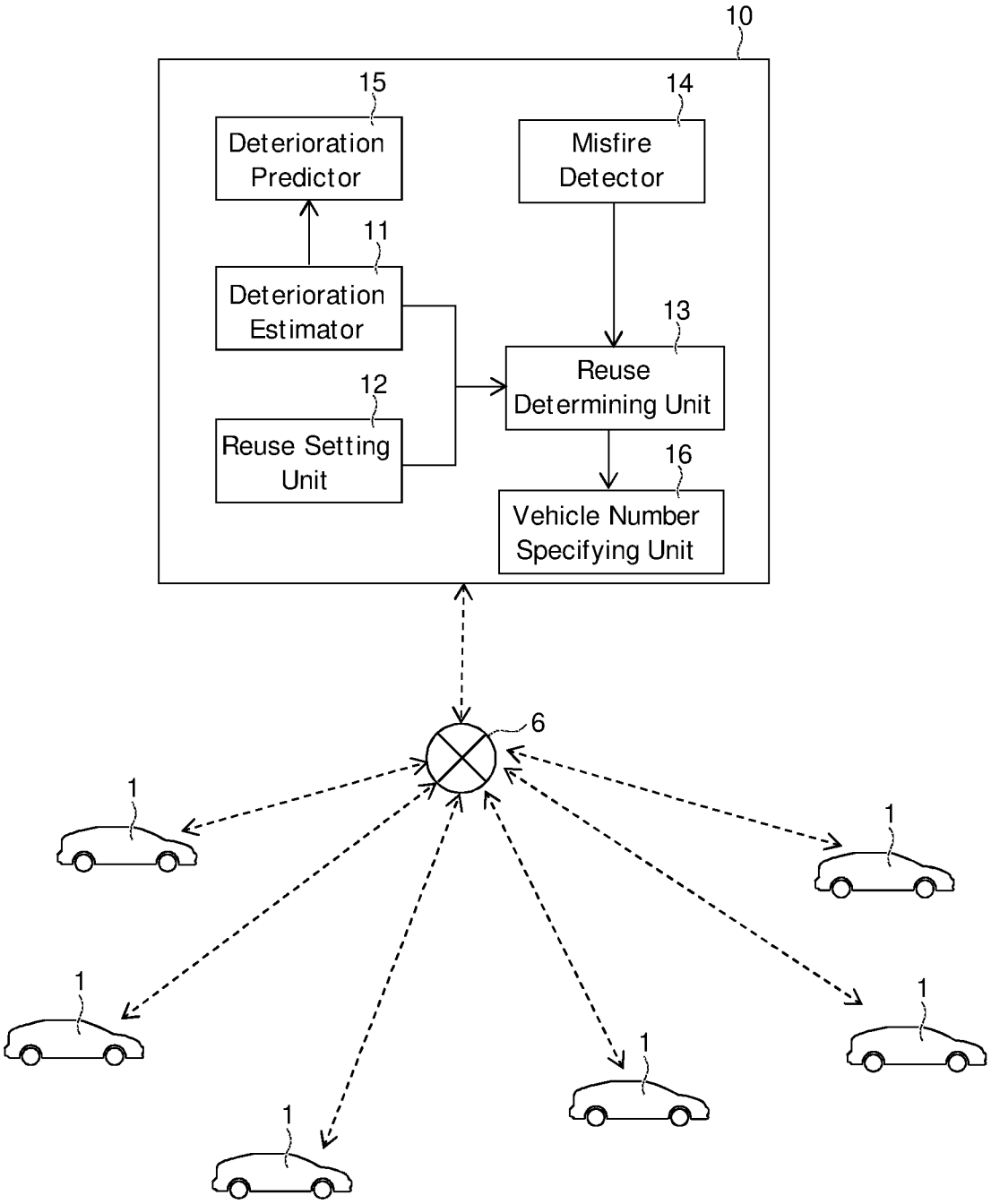
FIG. 9 is a schematic diagram that illustrates a modification of the reuse evaluation system illustrated in FIG. 3.

Note that, while in this embodiment, the reuse evaluation system 10 is mounted on the vehicle 1, for example, as illustrated in FIG. 9, the reuse evaluation system 10 may be disposed outside the vehicle in a form of a server, and the reuse evaluation system 10 may perform evaluations of reuse of a plurality of the vehicles 1 via a network 6.

In this case, the deterioration estimator 11 of the reuse evaluation system 10 estimates the degree of deterioration of the catalyst 81 for each of the vehicles 1 with respect to the catalysts 81 of the plurality of vehicles 1. The reuse determining unit 13 determines whether the catalyst 81 is reusable in the reuse usage of the catalyst 81 for each of the vehicles 1.

The reuse evaluation system 10 further includes a vehicle number specifying unit 16 in addition to those illustrated in FIG. 3. The vehicle number specifying unit 16 identifies the vehicle 1 that includes the catalyst 81 determined to be reusable and the number thereof with respect to the plurality of vehicles among the plurality of vehicles 1. More specifically, in this embodiment, the reuse setting unit 12 sets the range of the degree of deterioration of the catalyst 81 for each of the plurality of reuse usages A to C. Accordingly, the vehicle number specifying unit 16 identifies the vehicle 1 determined to have the reusable catalyst 81 and the number thereof for each usage with respect to the plurality of vehicles 1.

Since this aspect identifies the vehicle 1 including the reusable catalyst for the usages A to C and the number thereof with respect to the plurality of vehicles 1, the number of the catalysts 81 that can be supplied as the reusable catalyst 81 according to the usage can be controlled. This can easily secure the catalyst 81 to be reused for each usage before the vehicle 1 is discarded.

While one embodiment of the present disclosure has been described in detail, the present disclosure is not limited to the above-described embodiment, but various kinds of changes of design are allowed within a range not departing from the spirits of the present disclosure described in the claims.

What is claimed is:

1. A reuse evaluation system for performing an evaluation to reuse a catalyst in a state where the catalyst that purifies an exhaust gas of an engine of a vehicle is mounted on the vehicle, the system comprising:

a processor configured to:

determine a degree of deterioration of the catalyst based on an operating state of the vehicle;

set one range of a plurality of ranges of degrees of deterioration of the catalyst as a reuse range of the catalyst according to a usage of reuse of the catalyst, the reuse range being a range of reuse of the catalyst upon a separate use after a use in the vehicle, and each of the plurality of ranges of degrees of deterioration of the catalyst is based on a different reusability of the catalyst; and determine that the catalyst is reusable for the reuse range upon the separate use when the determined degree of deterioration of the catalyst is within the set reuse range.

2. The reuse evaluation system for the catalyst according to claim 1, further comprising a misfire detector that detects a misfire of the engine, wherein when the misfire detector has detected the misfire of the engine, the processor determines that the catalyst is unreusable.

3. The reuse evaluation system for the catalyst according to claim 1, wherein the processor determines the degree of deterioration of the catalyst based on at least one of an output accumulated time, a bed temperature accumulated time, or a combustion accumulated time in a time period from when the vehicle was manufactured until the degree of deterioration of the catalyst is determined, the accumulated time being an accumulated time where the engine is within a predetermined output range, the bed temperature accumulated time being an accumulated time where a bed temperature of the catalyst is within a predetermined range, and the combustion accumulated time being an accumulated time where the engine performed lean burn.

4. The reuse evaluation system for the catalyst according to claim 3, wherein the processor is configured to:

perform machine learning of a calculation of the degree of deterioration of the catalyst using the output accumulated time, the bed temperature accumulated time, the combustion accumulated time, and the degree of deterioration of the catalyst as teacher data for each catalyst of a plurality of catalysts, and receive the output accumulated time, the bed temperature accumulated time, and the combustion accumulated time of a catalyst to determine a target degree of deterioration, and calculate the degree of deterioration of the catalyst as the target degree of deterioration.

5. The reuse evaluation system for the catalyst according to claim 3, wherein the processor is configured to determine a progress of the degree of deterioration of the catalyst corresponding to the accumulated time from any one of the accumulated times of the output accumulated time, the bed temperature accumulated time, or the combustion accumulated time, and the determined degree of deterioration of the catalyst.

6. The reuse evaluation system for the catalyst according to claim 1, wherein the processor is configured to:

set the one range of the plurality of ranges of the degree of deterioration of the catalyst for each of a plurality of reuse usages, and determine whether the catalyst is reusable based on the one range of the plurality of ranges of the degree of deterioration of the catalyst set for each of the plurality of reuse usages.

7. The reuse evaluation system according to claim 1, wherein the processor is configured to:

determine the degree of deterioration of the catalyst of each of a plurality of vehicles with respect to catalysts of the plurality of the vehicles, and identify a vehicle including a catalyst determined to be reusable among the plurality of vehicles and identify a number of the vehicle.

* * * * *